United States Patent [19]

Horodysky et al.

[11] 4,427,562

[45] Jan. 24, 1984

[54] FRICTION REDUCERS FOR LUBRICANTS AND FUELS

[75] Inventors: Andrew G. Horodysky, Cherry Hill; Milton Braid, Haddonfield, both of N.J.

[73] Assignee: Mobil Oil Corporation, New York, N.Y.

[21] Appl. No.: 375,413

[22] Filed: May 6, 1982

[51] Int. Cl.[3] ..... C10M 1/32

[52] U.S. Cl. ..... 252/51.5 A; 252/392; 252/403; 44/71

[58] Field of Search ..... 252/34, 51.5 A, 392, 252/403; 44/71

[56] References Cited

U.S. PATENT DOCUMENTS 3,037,056 5/1962 Lowe et al. ..... 252/51.5 A
3,778,372 12/1973 Murphy ..... 252/51.5 A
3,907,704 9/1975 Murphy ..... 252/34
4,208,293 6/1980 Zaweski ..... 252/51.5 A

*Primary Examiner*—Jacqueline V. Howard
*Attorney, Agent, or Firm*—Alexander J. McKillop; Michael G. Gilman; Claude E. Setliff

[57] ABSTRACT

N-alkoxyalkyl amides may be formed by the reaction of primary alkoxyalkylamines with carboxylic acids such as formic acid, or alternatively by ammonolysis of the appropriate formate ester. The resultant amides exhibit friction reducing properties when incorporated in additive amounts in lubricants and fuels. Extremely low concentrations of such additives, i.e. N-alkoxyalkyl formamides in lubricating oils result in vastly improved, i.e. lowered coefficients of friction. By virtue of the friction reducing characteristics and lubricity properties, the additive compositions of the present invention exhibit reduced wear on rubbing surfaces.

8 Claims, No Drawings

FRICTION REDUCERS FOR LUBRICANTS AND FUELS

BACKGROUND OF THE INVENTION

1. Field of the Invention

The present invention relates to lubricant and fuel compositions which contain additive amounts of a friction reducing agent. More particularly it relates to such compositions having incorporated therein minor effective amounts of a N-etheramine formamide.

2. Summary of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe errosion of metal surfaces can take place even with present generation lubricants unless a load carrying or anti-wear additive is present therein.

Friction is also a problem anytime that two surfaces are in sliding or rubbing contact. It is of a special significance in internal combustion engines, because loss of substantial amounts of the theoretical mileage possible from a gallon of fuel is traceable directly to friction.

In the past many techniques have been employed to reduce the overall friction in modern engines, particularly automobile engines. The primary reasons for such effort included reduction in engine wear thereby prolonging engine life and additionally to reduce the amount of fuel consumed by the engine thereby reducing the engine's energy requirements for fuel consumption. In addition to the considerable amount of work which has been done with mineral lubricating oils and greases, modifying them with additives to enhance their friction properties, new lubricants have been synthesized and compounded for use in modern engines. Among these are synthetic hydrocarbon fluids and synthetic ester blends which are known to reduce fuel consumption by significant amounts. However, with respect to these latter synthetic formulations the physical properties of the oil itself provide improved lubricating properties and not the additives therein.

Included amongst the myriad of anti-friction additives which have been employed in fuels and lubricants in the past are such compositions as imidazolines and certain esters thereof, see for example U.S. Pat. No. 4,298,486. Also, amides such as N-pyridyl amides are described in U.S. Pat. No. 3,884,822 which are known to enhance the anti-rust characteristics of lubricant compositions.

SUMMARY OF THE INVENTION

In accordance with the present invention, there is provided a lubricating oil composition and an amount, sufficient to provide fuel reduction in an internal combustion engine, as well as to reduce the friction characteristics of lubricants containing such materials, from about less than 0.1% to about 10% by weight and preferably from about 0.5% to about 5.0% by weight and more preferably from about 1.0% up to about 3.0% by weight of a N-etheramine formamide formed as the reaction product of a primary alkoxyalkylamine with a carboxylic acid or alternatively by the ammonolysis of the appropriate formate ester.

DESCRIPTION OF SPECIFIC EMBODIMENTS

The friction reducing compounds of the present invention may be made by (1) reacting a primary alkoxyalkylamine with a carboxylic acid or (2) by ammonolysis of the appropriate formate ester. The products of such reactions are N-alkoxyalkyl amides which in accordance with the present invention have been found to reduce the coefficient of friction of lubricating oils which contain these materials, in additive amounts, by more than 30%. By virture of their inherent friction reducing characteristics and lubricity properties, the compounds result in reduced wear on rubbing surfaces.

The etheramine amide additives of the present invention are ashless, non-metallic and contain no potentially deleterious chlorine, phosphorus or sulfur. The additive compositions of the present invention have not heretofore been employed as multi-functional friction reducing additives in lubricating fluids and/or greases, or in fuel applications.

The N-etheramine amides additives of the present invention may be made in accordance with the following generalized reaction scheme example:

$$R{-}O{-}R^1{-}NH_2 + R^2COOR^3 \longrightarrow R{-}O{-}R^1{-}NH\overset{\overset{\displaystyle O}{\|}}{C}{-}R^2 + HOR^3$$

where

R can be hydrocarbyl, preferably 5–30 carbons, and is preferably alkyl but can be inclusive of alkenyl;

$R^1$ can be hydrocarbyl, preferably an alkylene group of 2–10 carbons;

$R^2$ is preferably hydrogen; and $R^3$ can be hydrogen or a hydrocarbyl group, preferably 1–4 carbon atoms.

R may be a specific alkyl group such as, for example, dodecyl, tetradecyl and the like, but is more preferably a mixture of hydrocarbyl groups. Additionally R is preferably linear alkyl.

The N-etheramine amides have been found to demonstrate excellent friction reducing characteristics and have been found to be effective in lubricant formulations at low additive concentrations of 1% and below. The etheramine formamides provide substantial improvement in the gasoline fuel economy of already fuel efficient synthetic lubricant compositions and find application in a wide variety of other automotive and industrial lubricants, greases and fuels. The amide additive compositions of the present invention may be prepared from commercially available, relatively inexpensive raw materials via a one-step, one-pot condensation or ammonolysis reaction. Such economically favorable and commercially feasible processes may be implemented in conventional equipment. The additives have been found to be ashless, non-metallic and do not contain any potentially deleterious elements, including phosphorus, sulfur or chlorine moieties.

Of particular significance, in accordance with the present invention, is the ability to improve the friction properties of oleaginous materials such as lubricating media which may comprise either mineral oil or a synthetic oil, or a grease therefrom. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably from about 50 to 250 SSU at 210° F. These oils may have viscosity indexes ranging to about 100 or higher. Viscosity indices from about 70 to about 95 are preferred. The average molecular weights of these oils may range from about 250 to about 800.

In instances where synthetic oils are desired in preferance to mineral oils, or in combination therewith, various compounds of this type may be successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted bis (p-phenoxy phenol) ether, and phenoxy phenylethers.

It is to be understood, however, that the compositions contemplated herein can also contain other materials. For example, corrosion inhibitors, extreme pressure agents, pour depressants, viscosity index improvers, co-antioxidants, antiwear agents and the like can be used. Such additive compounds include specifically sulfonates, phenates, zince dithiophosphate, polymethacrylate, olefin copolymers, succinimides and the like. These materials do not detract from the value of the compositions of this invention, but rather they serve to impart their customary properties to the particular compositions in which they are incorporated.

In general, the additive compounds of the present invention may be employed in any amount which is effective for imparting the desired degree of friction reduction or antiwear activity. In many applications, however, the additive is effectively employed in amounts from about less than 0.1% to about 10% by weight, and preferably from about 0.5% to about 5% of the total weight of the compositon.

As hereinbefore noted the additive compounds of the present invention may be advantageously employed in effective amounts in fuel compositions. For example, the additives of the present invention may be employed in hydrocarbon fuels such as gasoline or diesel fuels. The present additive compounds may also be employed in alcoholic fuels such as methanol or ethanol or mixtures of hydrocarbon and alcoholic fuels. In fuel additive applications the additives of the present invention may be employed in amounts from about 2 pounds per 1000 barrels up to about 500 pounds per 1000 barrels and preferably from about 5 up to about 50 pounds per 1000 barrels.

The following examples and data are intended to illustrate specific embodiments of the present invention only and, accordingly, should not be construed in a limiting sense.

EXAMPLE 1

N-Mixed $C_{12}$–$C_{15}$ Alkoxypropyl Formamide

Approximately 195 g of mixed $C_{12}$–$C_{15}$ alkoxypropylamine (commercially obtained as Armak Armeen EA-25 primary ether amine) having the following general structure:

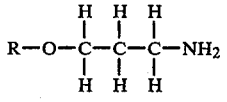

where R is a hydrocarbyl chain containing about 20% $C_{12}$, about 30% $C_{13}$, about 30% $C_{14}$ and about 20% $C_{15}$ and the average molecular weight is 260 and the primary amine content is 90%; and 80 g toluene were charged to a 1 liter stirred reactor equipped with a Dean Stark condensing trap. Approximately 43 g of 88% formic acid was added with agitation and the mixture was heated for four hours until water evolution ceased. The reaction mixture was heated to 170° C. and unreacted starting materials and solvent were removed by vacuum distillation. The product was filtered through paper at about 100° C.

EXAMPLE 2

N-Mixed $C_8$–$C_{10}$ Alkoxypropyl Formamide

Approximately 40 g of mixed $C_8$–$C_{10}$ alkoxypropylamine (commercially obtained as Armak Armeen EA-80 primary ether amine) having the following general structure:

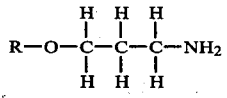

where R is a hydrocarbyl chain containing about 5% $C_6$, about 56% $C_8$, and about 39% $C_{10}$ and the average molecular weight is 200 and the primary amine content is 85%; and about 60 g toluene were charged to a 1 liter stirred reactor equipped with a Dean Stark condensing trap. Approximately 13 g of 88% formic acid was added with agitation and the mixture was heated for five hours until water evolution ceased. The reaction mixture was heated to 170° C. and unreacted starting materials and solvent were removed by vacuum distillation. The product was filtered through paper at about 100° C.

EVALUATION OF THE COMPOUNDS

The compound produced in accordance with Example 1 was evaluated in a Low Velocity Friction Apparatus (LVFA) in a fully formulated 5W–30 oil containing an additive package including antioxidant, dispersant and detergent. The friction reducing compound was evaluated at 1% and 2% of the total weight of oil. The base oil had the following general characteristics:

Kinematic Viscosity:
@100° C.–11.0 cs.
@40° C.–58.2 cs.
Viscosity Index: 172

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 $in^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a levercam-motor arrangement.

Procedure

The rubbing surfaces and 12–13 ml. of test lubricants are placed on the LVFA. A 240 psi load is applied, and the sliding speed is maintained at 40 fpm at ambient temperature for a few minutes. A plot of coefficients of friction (Uk) over the range of sliding speeds, 5 to 40 fpm (25–195 rmp), is obtained. A minimum of three measurements is obtained for each test lubricant. The the test lubricant and specimens are heated to 250° F., another set of measurements is obtained and the system is run for 50 min. at 250° F., 240psi, and 40 fpm sliding speed. Afterward, measurements of Uk vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psig.

TABLE 1

Friction Reduction Properties Using the Low Velocity Friction Apparatus

| | Additive Conc. Wt. % | Reduction or % Change Coefficient of Friction 5 Ft./Min. | 30 Ft./Min. |
|---|---|---|---|
| Example No. | | | |
| Base oil (fully formulated engine oil containing detergent/dispersant inhibitor package) | — | 0 | 0 |
| Example 1 | | | |
| N-Mixed $C_{12}$–$C_{15}$ alkoxypropyl formamide | 2 | 31 | 36 |
| | 1 | 25 | 30 |
| Example 2 | | | |
| N-Mixed $C_8$–$C_{10}$ alkoxypropyl formamide | 2 | 19 | 21 |

The measured coefficients of friction were significantly reduced relative to the base oil reduction as high as 36%. Friction was reduced by 30% when measured at the higher sliding speed of 30 FT./Min. with the admixture of only 1% of N-mixed $C_{12}$–$C_{15}$ alkoxypropyl formamide to the test oil.

The products were also evaluated for oxidation stability. In most cases improvements in oxidative stability over the base oil were observed. Basically the test lubricant is subjected to a stream of air which is bubbled through at the rate of 5 liters per hour at 425° F. for 24 hours. Present in the composition are samples of metals commonly used in engine construction, namely iron, copper, aluminum and lead. See U.S. Pat. No. 3,682,980, incorporated herein by reference, for further details of the test. Improvement in Viscosity index or neutralization number (or both) show effective control. See the results in Table 3.

TABLE 2

Oxidation Characteristics
Catalytic Oxidation Test, 40 Hours @ 325° F.

| | Additive Conc. Wt. % | % Increase in Viscosity of Oxidized Oil Using KV @ 100° C. | Neut. Number |
|---|---|---|---|
| Example | | | |
| Base Oil (200" solvent paraffinic neutral lubricating oil) | — | 67 | 3.62 |
| Example 1 | | | |
| N-Mixed $C_{12}$–$C_{15}$ | 0.5 | 13 | 2.21 |
| alkoxylpropyl formamide | 1.0 | 16 | 2.33 |

The results clearly show the stability exhibited by the formamide under sever oxidizing conditions at elevated temperatures.

TABLE 3

Copper Strip Corrosivity Characteristics

| | Additive Conc. Wt. % | Test Rating ASTM D130-80 3 Hrs. @ 250° F. | ASTM D130-80 6 Hrs. @ 210° F. |
|---|---|---|---|
| Example 1 | 0.5 | 1A | 1A |
| | 1.0 | 1A | 1A |
| Example 2 | 0.1 | 1A | 1A |
| | 1.0 | 1A | 1A |

The results clearly show the etheramine amide product to be non-corrosive to copper.

What is claimed is:

1. A lubricant or fuel composition comprising a major amount of an oil of lubricating viscosity, a grease prepared therefrom or a liquid hydrocarbon fuel and a minor amount of an additive effective for providing friction reducing, copper anti-corrosion or antioxidant properties to said composition comprising an amide represented by the following formula:

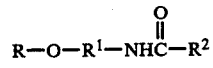

wherein R is a hydrocarbyl group or a mixture of hydrocarbyl groups containing from about 5–30 carbon atoms; $R^1$ is a hydrocarbyl group containing from about 2–10 carbon atoms; and $R^2$ is hydrogen.

2. The lubricant composition of claim 1 wherein said additive is prepared by the reaction of a primary alkoxyalkylamine with a carboxylic acid.

3. The lubricant composition of claim 1 wherein said additive is prepared by the ammonolysis of a formate ester with a N-alkoxyalkylamine.

4. A composition as described in claim 2 wherein said alkoxyalkylamine is an alkoxyalkyl propylamine represented by the following structural formula:

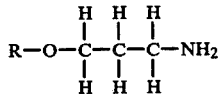

wherein R is a hydrocarbyl group containing about 20% $C_{12}$, about 30% $C_{13}$, about 30% $C_{14}$, and about 20% $C_{15}$.

5. A composition as described in claim 2 wherein said alkoxyalkylamine is an alkoxyalkyl propylamine represented by the following structural formula:

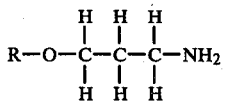

wherein R is a hydrocarbyl group containing about 56% $C_8$, about 39% $C_{10}$ and about 5% $C_6$.

6. A lubricant composition as defined in claim 2 wherein said carboxylic acid is formic acid.

7. A method for reducing the friction and copper corrosion characteristics and improving the antioxidant properties of a lubricant composition which comprises adding to a lubricant composition, comprising an oil of lubricating viscosity or grease prepared therefrom, a minor effective amount of an additive, said additive comprising a N-alkoxyalkyl amide.

8. A method for reducing the fuel consumption in an internal combustion engine which comprises adding to the lubricant or fuel a minor effective amount of an additive, said additive comprising a N-alkoxylalkyl amide.

* * * * *